US011686542B2

(12) United States Patent
Amir et al.

(10) Patent No.: US 11,686,542 B2
(45) Date of Patent: Jun. 27, 2023

(54) TWO PART PISTOL SLIDE

(71) Applicant: ISRAEL WEAPON INDUSTRIES (I.W.I.) LTD., Ramat HaSharon (IL)

(72) Inventors: Lior Amir, Ra'anana (IL); Haim Nidam, Ramat-Gan (IL)

(73) Assignee: ISRAEL WEAPON INDUSTRIES (I.W.I) LTD., Ramat Hasharon (IL)

( * ) Notice: Subject to any disclaimer, the term of this patent is extended or adjusted under 35 U.S.C. 154(b) by 0 days.

(21) Appl. No.: 17/744,763

(22) Filed: May 16, 2022

(65) Prior Publication Data

US 2023/0045746 A1 Feb. 9, 2023

(30) Foreign Application Priority Data

Aug. 3, 2021 (IL) ..... 285340

(51) Int. Cl.

| | |
|---|---|
| ***F41A 3/86*** | (2006.01) |
| ***F41A 3/66*** | (2006.01) |
| ***F41A 11/00*** | (2006.01) |
| ***F41C 3/00*** | (2006.01) |

(52) U.S. Cl.

CPC ..... *F41A 3/86* (2013.01); *F41A 3/66* (2013.01); *F41A 11/00* (2013.01); *F41C 3/00* (2013.01)

(58) Field of Classification Search

CPC .... F41A 3/86; F41A 3/66; F41A 11/00; F41C 3/00

See application file for complete search history.

(56) References Cited

U.S. PATENT DOCUMENTS

| | | | | |
|---|---|---|---|---|
| 3,724,326 | A | 4/1973 | Day | |
| 4,127,056 | A | 11/1978 | Cart | |
| 4,409,882 | A | 10/1983 | Blackshaw et al. | |
| 4,485,723 | A | 12/1984 | Sarong | |
| 5,955,696 | A | 9/1999 | Meller | |
| 11,441,858 | B2 * | 9/2022 | Borges | F41A 3/66 |
| 2017/0191769 | A1 | 7/2017 | Martindill et al. | |
| 2021/0325141 | A1 * | 10/2021 | Mumford | F41A 3/66 |
| 2022/0221237 | A1 * | 7/2022 | Nelson | F41C 3/00 |

FOREIGN PATENT DOCUMENTS

GB 190919589 A 5/1910

* cited by examiner

*Primary Examiner* — J. Woodrow Eldred
(74) *Attorney, Agent, or Firm* —
Soroker-Agmon-Nordman; Daniel Schatz; Sharone Godesh

(57) ABSTRACT

A pistol slide, including an upper part configured to guide a barrel of the pistol, a lower part configured to guide a recoil spring guide rod and a recoil spring, wherein the upper part and lower part are manufactured independently and coupled together to serve as the pistol slide.

15 Claims, 6 Drawing Sheets

TWO PART PISTOL SLIDE

FIELD OF THE DISCLOSURE

The present disclosure relates to a pistol slide that includes a separate part, which serves as a recoil spring housing.

BACKGROUND OF THE DISCLOSURE

Typically, pistols are equipped with a recoil spring beneath the barrel within the slide to counter the recoil motion when releasing a bullet and returning the slide forward to full battery position. The recoil spring is generally held in place inside the slide with the aid of a recoil spring guide rod.

The slide may be manufactured by machining a solid block of metal, forged from a solid piece of metal, cast or injected in a mold. The slide is manufactured as a robust solid unit having an upper part that guides the barrel and a lower part that guides the recoil spring guide rod. When releasing a bullet the slide recoils until reaching a rear stop and then the recoil spring pushes forward the slide to battery When forming the slide from an elongated metal block, the block is machined to form a hollow enclosure in the upper part of the metal block to accommodate the barrel of the pistol. Generally, in the lower part of the metal block most of the metal block is discarded and only a small portion is left to guide the recoil spring guide rod and recoil spring. Typically, more than half of the metal block is discarded and in the lower part a higher percentage of the block is thrown away than in the upper part.

Additionally, the existence of the lower part while preparing the upper part hinders manufacture of the upper part. Likewise, the existence of upper part while preparing the lower part hinders manufacture of the lower part.

SUMMARY OF THE DISCLOSURE

An aspect of an embodiment of the disclosure, relates to a pistol slide and a method for producing the slide, wherein the slide comprises two separate parts that are manufactured independently:

An upper part configured to guide the barrel; and

A lower part configured to guide a recoil spring system, which includes a recoil spring and recoil spring guide rod.

The upper part and lower part are coupled together to form a solid slide. The upper part and lower part may be coupled together by welding, riveting or other rigid attachment methods or joined together using additional parts. Alternatively, the upper part and lower part may be fitted together using rails, grooves or other non-rigid attachment methods, so that they may be disassembled. The non-rigid attachments are configured so that the two parts will not come apart when the slide recoils.

There is thus provided according to an embodiment of the disclosure, a pistol slide, comprising:

An upper part configured to guide a barrel of the pistol;

A lower part configured to guide a recoil spring guide rod and recoil spring;

Wherein the upper part and lower part are manufactured independently and coupled together to serve as the pistol slide.

In an embodiment of the disclosure, the upper part includes a rail to attach the lower part to the upper part. Optionally, the lower part includes a rim to attach the lower part to the upper part. In an embodiment of the disclosure, a front of the upper part includes a protrusion to prevent a front of the lower part from moving beyond the front of the upper part.

In an embodiment of the disclosure, the upper part and lower part are welded together. Optionally, the lower part is manufactured by the same process and materials as the upper part. Alternatively, the lower part is manufactured by a different process or different materials than the upper part. In an embodiment of the disclosure, the lower part forms a partial enclosure around the recoil spring from at least four sides, when the slide is at the most rear position. Optionally, the upper part includes a circular outlet on the front of the pistol configured for the barrel to pass through when the slide recoils. In an embodiment of the disclosure, the lower part includes a circular outlet on the front of the pistol configured for the recoil spring guide rod to pass through when the slide recoils. Optionally, a length of an elongated side of the lower part is selected to be stopped by a rear stopper in the pistol.

There is further provided according to an embodiment of the disclosure, a method of manufacturing a pistol slide, comprising:

Manufacturing an upper part configured to guide a barrel of the pistol;

Independently manufacturing a lower part configured to guide a recoil spring guide rod and recoil spring; and Coupling the lower part to the upper part to form the slide.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1:
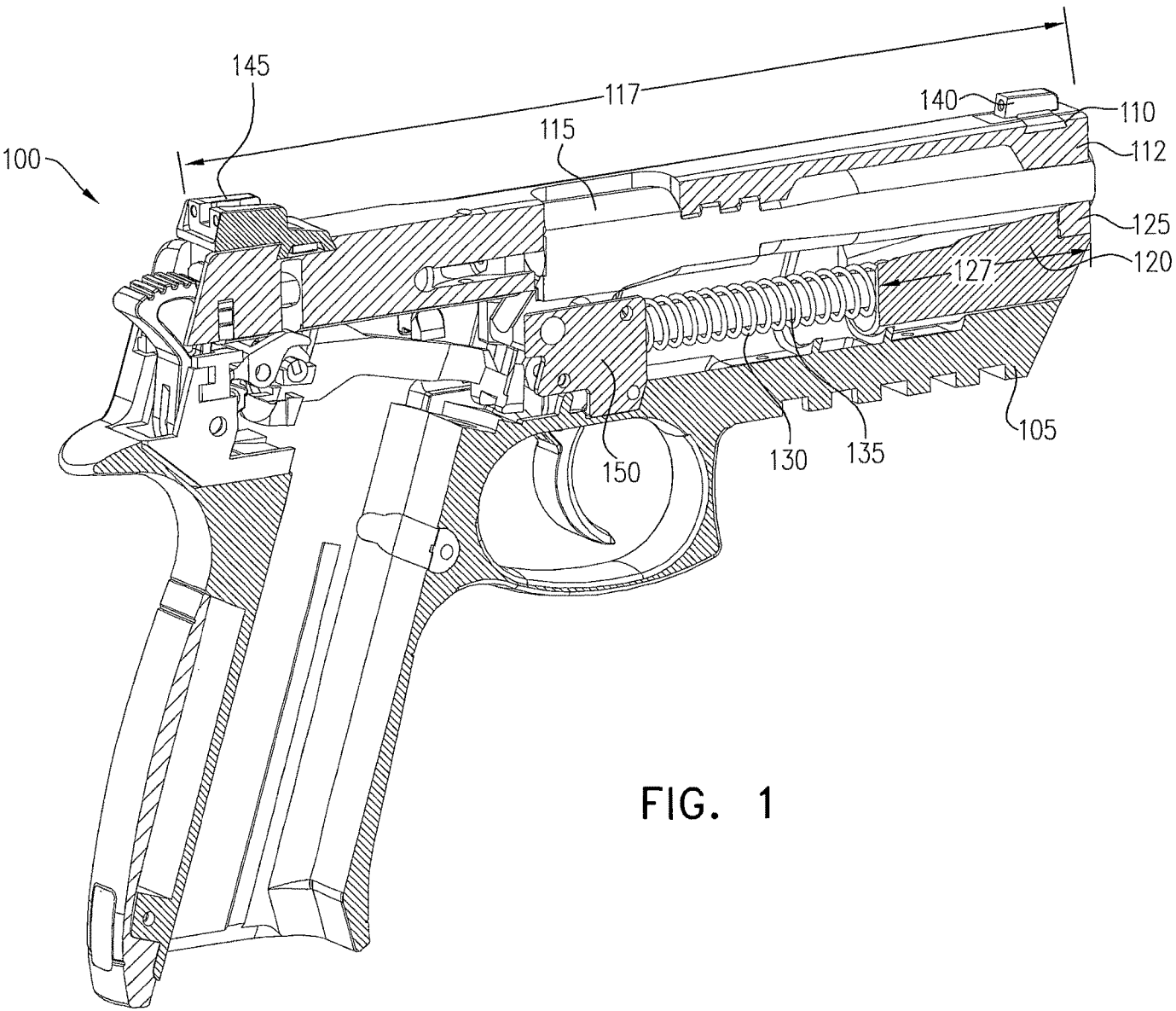
FIG. 1 is a schematic illustration of a partially transparent perspective view of a pistol with an independent recoil spring housing, according to an embodiment of the disclosure.
Figure 2:
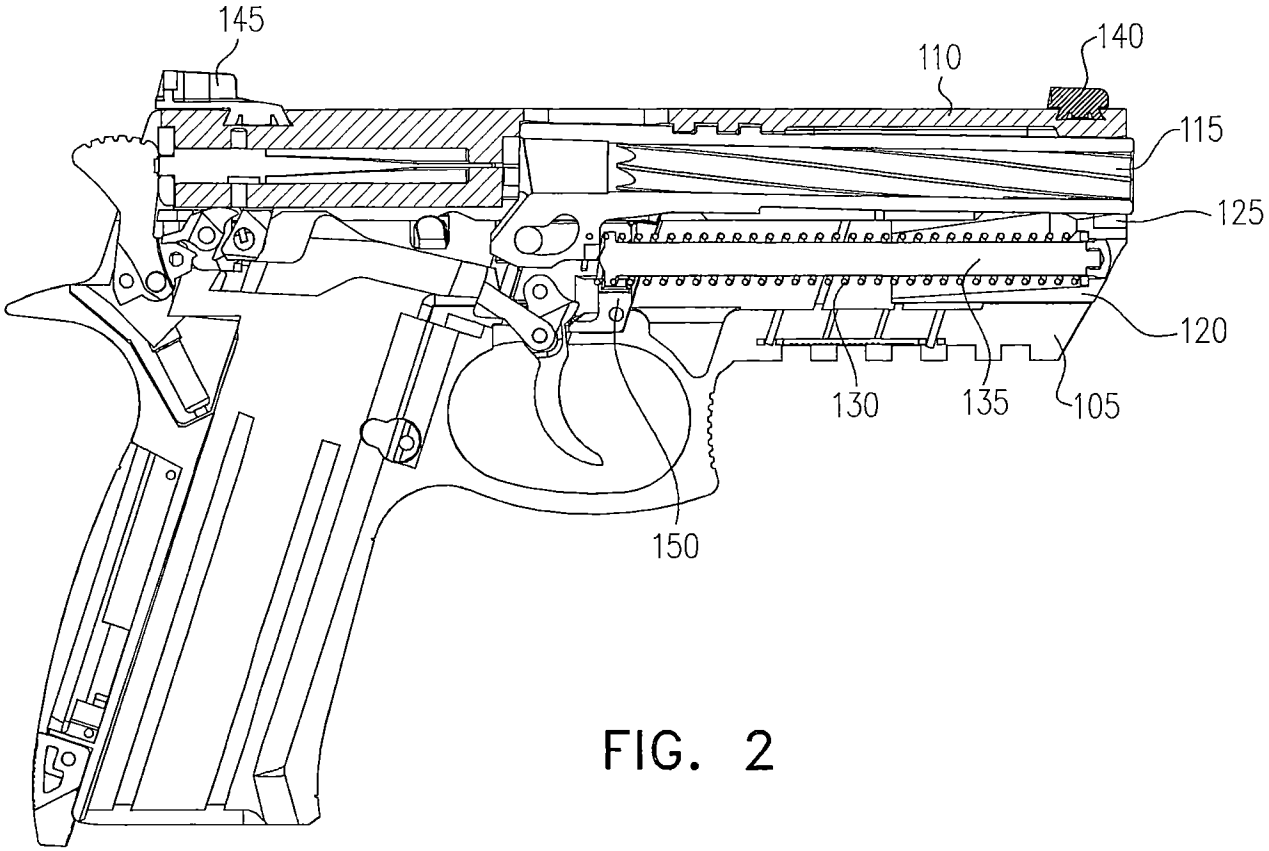
FIG. 2 is a schematic illustration of a partially transparent side view of a pistol with an independent recoil spring housing, according to an embodiment of the disclosure.

FIG. 1 is a schematic illustration of a partially transparent perspective view of a pistol 100 with an independent recoil spring housing 120 and FIG. 2 is a schematic illustration of a partially transparent side view of a pistol 100 with an independent recoil spring housing 120, according to an embodiment of the disclosure. In an embodiment of the disclosure, pistol 100 includes a slide 110 that is made up from two parts that are manufactured independently as solid units, for example machined from a solid bar of metal. An upper part 112 that encloses and guides a barrel 115 and a lower part 120 also referred to as a recoil spring housing 120. The lower part 120 is coupled to the upper part 112 and serves to enclose and guide a recoil spring guide rod 135, which supports a recoil spring 130.

In an embodiment of the disclosure, the slide 110 is configured to be moveably mounted on a pistol frame 105 to enable firing with the pistol 100. Optionally, the upper part 112 and lower part 120 are rigidly attached together to form slide 110 that moves as a single unit. The attachment may be a permanent attachment, for example by welding, riveting, gluing or any other type of rigid attachment. Alternatively, the attachment may be a non-permanent attachment, for example by bolts or rails. Optionally, not manufacturing the upper part 112 and the lower part 120 together simplifies manufacture, for example by having a simpler mold or making it easier to form the slide 110 by machining (e.g. easier access to each part). Additionally, forming the entire slide 110 as a single piece by machining a solid bar of metal causes additional waste compared with manufacturing each of the two parts of the slide 110 separately, for example starting with a smaller metal bar for the upper part 112.

The lower part 120 may be produced separately using the same material and production technology as the upper part 112. Alternatively, the lower part 120 is produced by a different production technology and/or material than the upper part 112. For example, the lower part 120 may be produced from cast iron or metal injection molding (MIM), which usually cannot be used to make the upper part 112. Making each part separately simplifies the manufacturing process and is more cost effective without losing the strength needed for the upper part.

Figure 3:
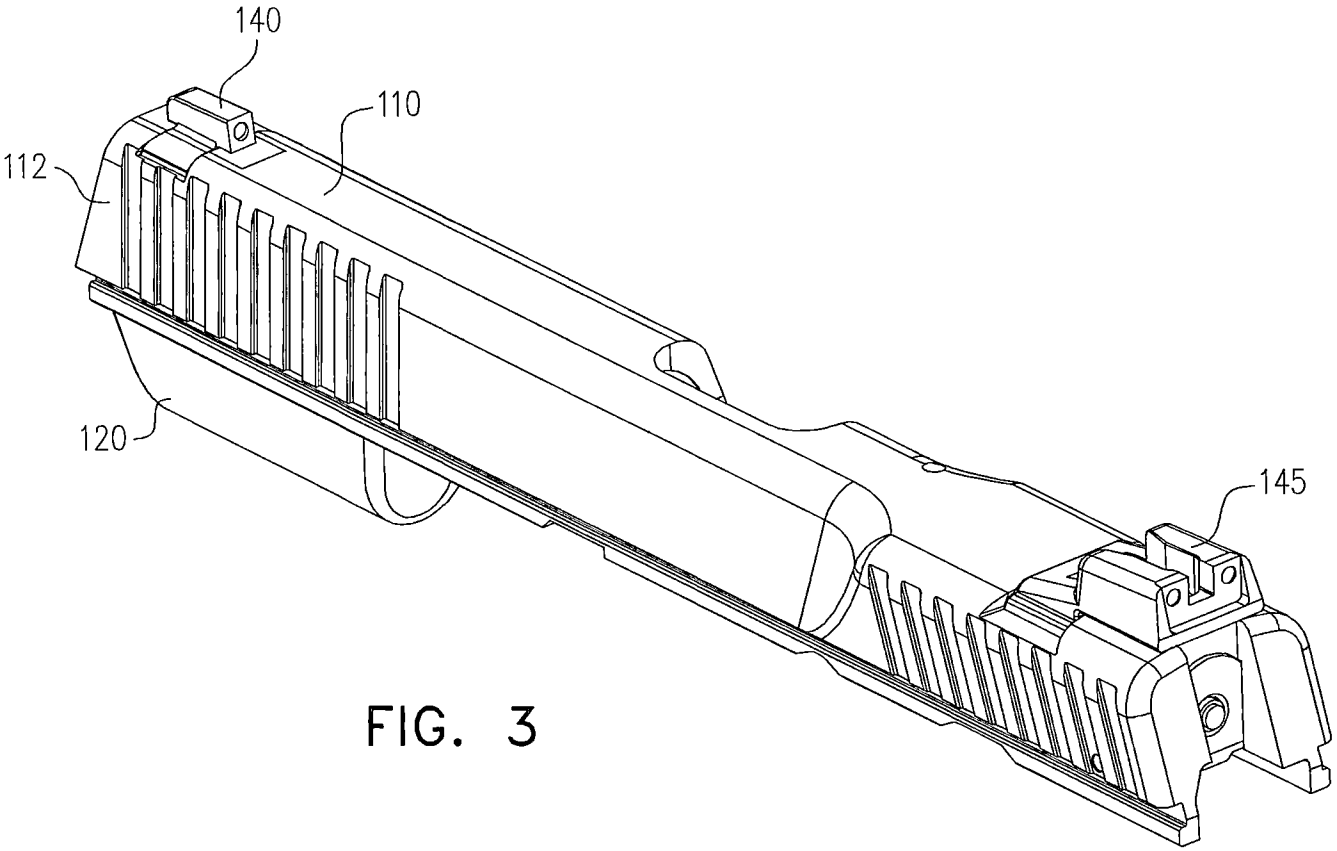
FIG. 3 is a schematic illustration of an assembled slide, according to an embodiment of the disclosure.
Figure 4:
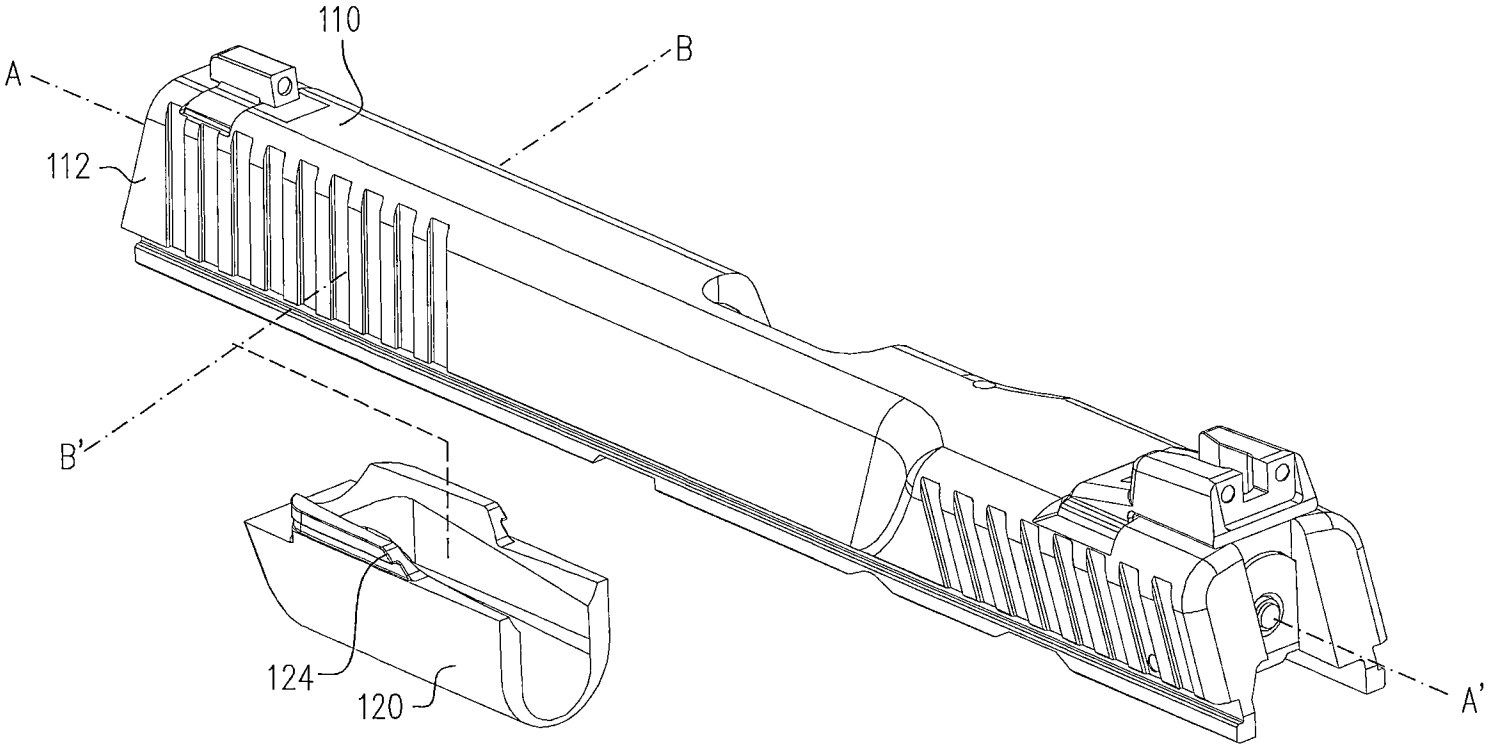
FIG. 4 is a schematic illustration of a disassembled slide, according to an embodiment of the disclosure.

FIG. 3 is a schematic illustration of an assembled slide 110, and FIG. 4 is a schematic illustration of a disassembled slide, according to an embodiment of the disclosure. Optionally, the slide 110 also includes a front sight 140 and a rear sight 145 for aiming the pistol at a target. In some embodiments of the disclosure, the upper part 112 includes an attachment rail 114 (e.g. FIG. 5) to attach the upper part 112 with the lower part 120. Optionally, the lower part 120 includes an attachment rim 124 that is configured to slide onto the attachment rail 114 of the upper part 112 and couple the lower part 120 to the upper part 112. In an embodiment of the disclosure, the upper part 112 includes a contact surface protrusion 125 (FIG. 2) on the front face of the pistol 100 to prevent the lower part 120 from sliding beyond the front face of the upper part 112. Additionally, the contact surface protrusion 125 pushes the lower part 120 toward the rear of the pistol 100 when the slide 110 recoils. When not recoiling recoil spring 130 exerts a force on the lower part 120 preventing it from sliding backward.

In an embodiment of the disclosure, the pistol 100 also includes a rear stopper 150 (FIGS. 1 and 2) to prevent the slide from recoiling more than a preselected distance. Optionally, the rear stopper 150 is implemented as a metal insert, which guides the slide and limits the motion of the lower part 120. In an embodiment of the disclosure, the length 127 (FIG. 1) of the elongated side of the lower part 120 is selected so that the rear end of the elongated side will be stopped by the rear stopper 150 when the slide 110 recoils.

Figure 5:
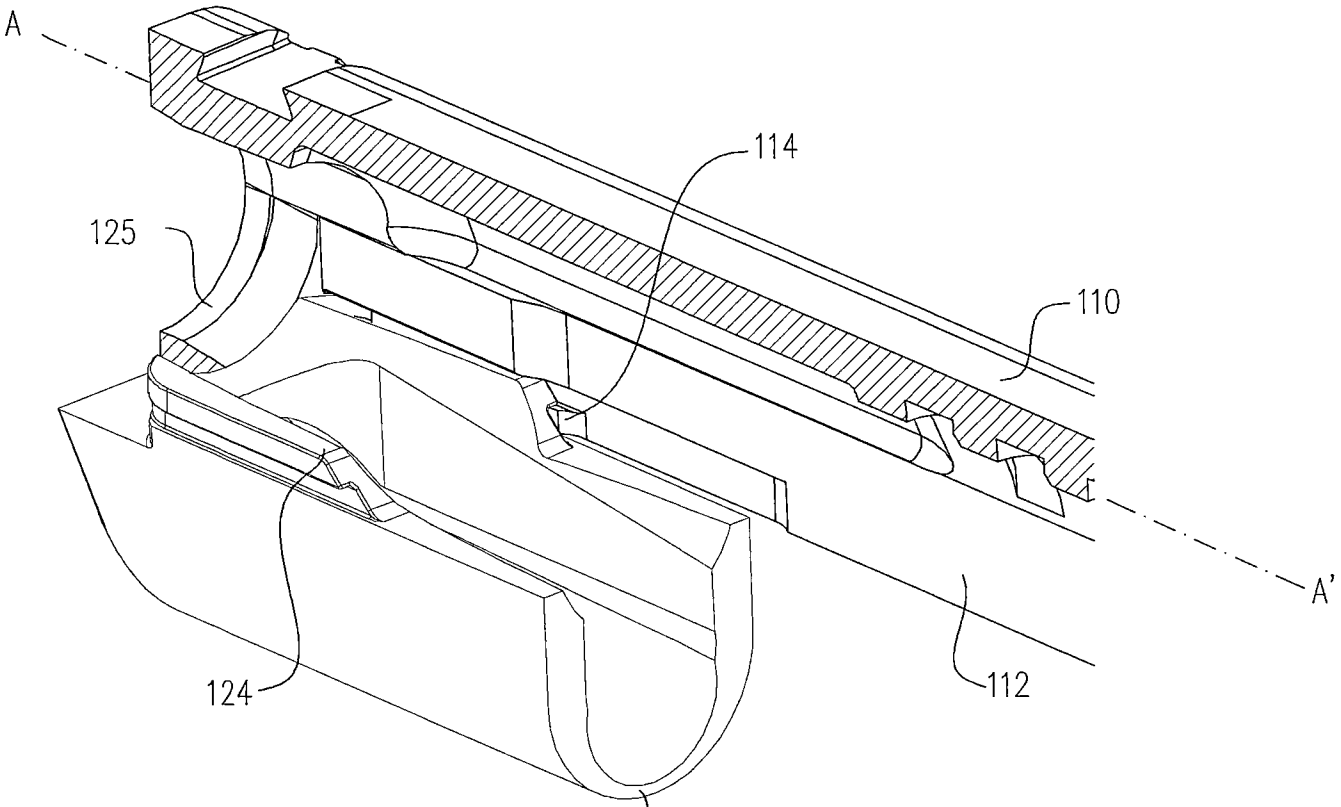
FIG. 5 is a schematic illustration of a cross sectional view AA' of an upper part of a slide and of a perspective view of a recoil spring housing, according to an embodiment of the disclosure.
Figure 6:
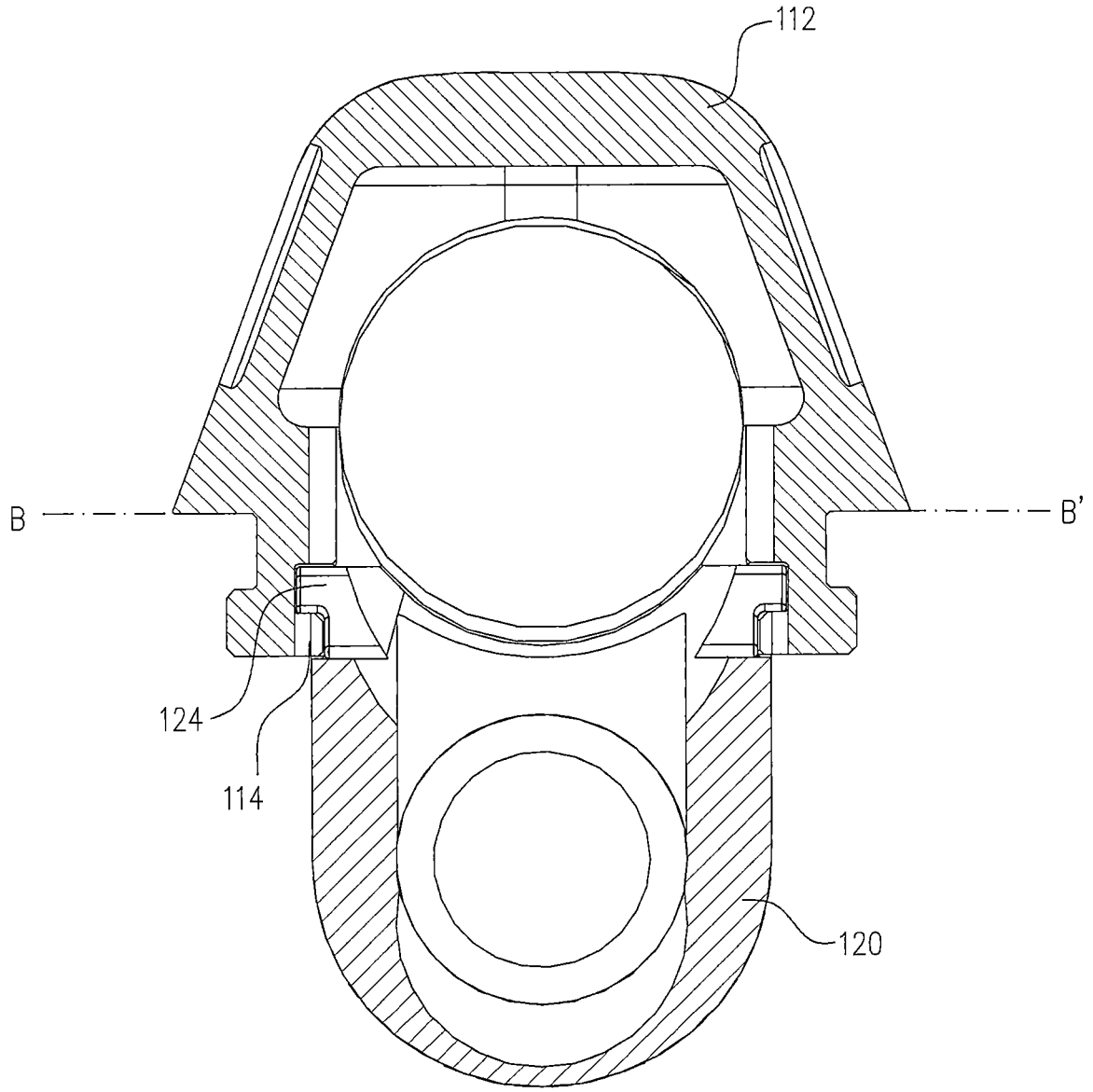
FIG. 6 is a schematic illustration of a cross sectional view BB' of an assembled slide, according to an embodiment of the disclosure.

FIG. 5 is a schematic illustration of a cross sectional view AA' of upper part 112 of slide 110 and of a perspective view of recoil spring housing 120 and FIG. 6 is a schematic illustration of a cross sectional view BB' of an assembled slide 110, according to an embodiment of the disclosure.

In some embodiments of the disclosure, the length 127 of the elongated side of lower part 120 is at least a tenth, a fifth, a fourth or a third of the length 117 of the elongated side of upper part 112 (e.g. 1-5 cm) to ensure a secure attachment between the two parts. Optionally, the length 127 of the elongated side of the lower part 120 is up to fifty or sixty percent of the length 117 of the elongated side of upper part 112, to allow recoil motion.

In an embodiment of the disclosure, the lower part 120 partially encloses around the recoil spring 130, for example on four sides (right, left, under and in front) as shown in FIG. 1, when the slide is at the most rear position.

In an embodiment of the disclosure, the upper part 112 has an outlet hole on the front of the pistol 100 for the barrel 115 (e.g. FIG. 1) to extend outward when the slide 110 retracts. Optionally, the lower part 120 includes an outlet hole for the recoil spring guide rod 135 to extend outward when the slide 110 retracts thereby squeezing the spring 130 toward the rear of the pistol 100.

In an embodiment of the disclosure, upper part 112 and lower part 120 are coupled together and secured to prevent uncontrolled separation during rearward motion when firing and forward motion is forced by the recoil spring. During rearward motion the upper part 112 pulls the lower part 120 and during forward motion the lower part 120 pushes the upper part 112. Optionally, contact surface protrusion 125 (see FIG. 1) sticks out from the upper part 112 and drags lower part 120 with upper part 112 when recoiling and also ensures that the upper part 112 is pushed by the lower part 120 when returning to the rest position.

It should be appreciated that the above described methods and apparatus may be varied in many ways, including omitting or adding elements or steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure.

It will be appreciated by persons skilled in the art that the present invention is not limited to what has been particularly shown and described hereinabove. Rather the scope of the present invention is defined only by the claims, which follow.

We claim:

1. A pistol slide, comprising:

an upper part configured to guide a barrel of the pistol;

a lower part configured to guide a recoil spring guide rod and recoil spring;

wherein the upper part and lower part are manufactured independently; and coupled together to serve as the pistol slide.

2. The pistol slide of claim 1, wherein the upper part includes a rail to attach the lower part to the upper part.

3. The pistol slide of claim 1, wherein the lower part includes a rim to attach the lower part to the upper part.

4. The pistol slide of claim 1, wherein a front of the upper part includes a protrusion to prevent a front of the lower part from moving beyond the front of the upper part.

5. The pistol slide of claim 1, wherein the upper part and lower part are welded together.

6. The pistol slide of claim 1, wherein the lower part is manufactured by the same process and materials as the upper part.

7. The pistol slide of claim 1, wherein the lower part is manufactured by a different process or different materials than the upper part.

8. The pistol slide of claim 1, wherein the lower part forms a partial enclosure around the recoil spring from at least four sides, when the slide is at the most rear position.

9. The pistol slide of claim 1, wherein the upper part includes a circular outlet on the front of the pistol configured for the barrel to pass through when the slide recoils.

10. The pistol slide of claim 1, wherein the lower part includes a circular outlet on the front of the pistol configured for the recoil spring guide rod to pass through when the slide recoils.

11. The pistol slide of claim 1, wherein a length of an elongated side of the lower part is selected to be stopped by a rear stopper in the pistol.

12. A method of manufacturing a pistol slide, comprising:

manufacturing an upper part configured to guide a barrel of the pistol;

manufacturing a lower part configured to guide a recoil spring guide rod and recoil spring; and coupling the lower part to the upper part to form the slide.

13. The method of claim 12, wherein the lower part is manufactured by the same process and materials as the upper part.

14. The method of claim 12, wherein the lower part is manufactured by a different process or different materials than the upper part.

15. The method of claim 12, wherein a length of an elongated side of the lower part is selected to be stopped by a rear stopper in the pistol.

* * * * *